US006695440B2

(12) United States Patent
Lebens et al.

(10) Patent No.: US 6,695,440 B2
(45) **Date of Patent: *Feb. 24, 2004**

(54) CONTINUOUS INK JET PRINTER WITH MICRO-VALVE DEFLECTION MECHANISM AND METHOD OF MAKING SAME

(75) Inventors: John A. Lebens, Rush, NY (US); Christopher N. Delametter, Rochester, NY (US); David P. Trauernicht, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/229,207

(22) Filed: Aug. 26, 2002

(65) Prior Publication Data

US 2003/0007039 A1 Jan. 9, 2003

Related U.S. Application Data

(62) Division of application No. 09/468,987, filed on Dec. 21, 1999.

(51) Int. Cl.[7] ..... B41J 2/095
(52) U.S. Cl. ..... 347/82
(58) Field of Search ..... 347/20, 73, 77, 347/82

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,878,519 A | | 4/1975 | Eaton | |
| 4,089,007 A | | 5/1978 | Perry et al. | |
| 4,346,387 A | | 8/1982 | Hertz | |
| 4,388,630 A | | 6/1983 | Osaki et al. | |
| 5,954,079 A | | 9/1999 | Barth et al. | |
| 5,969,736 A | | 10/1999 | Field et al. | |
| 6,474,795 B1 | * | 11/2002 | Lebens et al. | 347/82 |
| 6,536,882 B1 | * | 3/2003 | Hawkins et al. | 347/77 |
| 6,572,220 B1 | * | 6/2003 | Ross et al. | 347/55 |

FOREIGN PATENT DOCUMENTS

| | | |
|---|---|---|
| EP | 1 112 848 A3 | 12/2000 |
| JP | 02197631 | 6/1990 |
| JP | 05177843 A | 7/1993 |

OTHER PUBLICATIONS

Lane, R and Taub H.H., "Ink Jet Printer Using Drop Collision Modulation", "IBM Technical Disclosure Bulletin", vol. 18, No. 2, pp. 610–611, Jul. 1975.

* cited by examiner

*Primary Examiner*—Anh T. N. Vo
(74) *Attorney, Agent, or Firm*—Roland R. Schindler, II

(57) ABSTRACT

A continuous inkjet printer in which a continuous ink stream is deflected at the printhead nozzle bore without the need for charged deflection plates or tunnels. The printhead includes a primary ink delivery channel which delivers a primary flow of pressurized ink through an ink staging chamber to the nozzle bore to create an undeflected ink stream from the printhead. A secondary ink delivery channel adjacent to the primary channel is controlled by a thermally actuated valve to selectively create a lateral flow of pressurized ink into the primary flow thereby causing the emitted ink stream to deflect in a direction opposite to the direction from which the secondary ink stream impinges the primary ink stream in the ink staging chamber. A method of fabricating the printhead includes layering of the thermally actuated valve over the secondary ink delivery channel formed in a silicon substrate and creating the ink staging chamber over the delivery channels with sacrificial material which is later removed through the nozzle bore etched into the chamber wall formed over the sacrificial material.

12 Claims, 6 Drawing Sheets

CONTINUOUS INK JET PRINTER WITH MICRO-VALVE DEFLECTION MECHANISM AND METHOD OF MAKING SAME

CROSS REFERENCE TO RELATED APPLICATIONS

This is a Divisional of U.S. Ser. No. 09/468,987, filed Dec. 21, 1999, entitled CONTINUOUS INK JET PRINTER WITH MICRO-VALVE DEFLECTION MECHANISM AND METHOD OF MAKING SAME.

FIELD OF THE INVENTION

This invention relates generally to the field of digitally controlled printing devices, and in particular to continuous ink jet printheads which integrate multiple nozzles on a single substrate and in which print nonprint operation is effected by controlled deflection of the ink as it leaves the printhead nozzle.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand copies of a particular page are to be printed. Thus, there is a need for improved digitally controlled printing systems, for example, being able to produce high quality color images at a high-speed and low cost, using standard paper.

Inkjet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet. Continuous ink jet printing dates back to at least 1929. See U.S. Pat. No. 1,941,001 to Hansell.

U.S. Pat. No. 3,373,437, which issued to Sweet et al. in 1967, discloses an array of continuous ink jet nozzles wherein ink drops to be printed are selectively charged and deflected towards the recording medium. This technique is known as binary deflection continuous ink jet, and is used by several manufacturers, including Elmjet and Scitex.

U.S. Pat. No. 3,416,153, which issued to Hertz et al. in 1966, discloses a method of achieving variable optical density of printed spots in continuous ink jet printing using the electrostatic dispersion of a charged drop stream to modulate the number of droplets which pass through a small aperture. This technique is used in ink jet printers manufactured by Iris.

U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982 discloses a method and apparatus for controlling the electric charge on droplets formed by the breaking up of a pressurized liquid stream at a drop formation point located within the electric field having an electric potential gradient. Drop formation is effected at a point in the field corresponding to the desired predetermined charge to be placed on the droplets at the point of their formation. In addition to charging rings, deflection plates are used to deflect the drops.

Conventional continuous ink jet utilizes electrostatic charging rings that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium. In the current invention, the electrostatic tunnels and charging plates are unnecessary.

SUMMARY OF THE INVENTION

It is an object of the present invention to provide a high-speed continuous ink jet apparatus and method whereby drop formation and deflection may occur at high repetition.

It is another object of the present invention to provide a method of producing continuous the jet printing apparatus utilizing the advantages of selecting processing technology offering low cost, high volume methods of manufacture.

It is yet another object of the present invention to provide an apparatus and method for continuous ink jet printing that does not require electrostatic charging tunnels or deflection plates.

In accordance with an aspect of the invention, apparatus is provided for controlling ink in a continuous ink jet printer in which a continuous stream of ink is emitted from a nozzle wherein the apparatus comprises a reservoir of pressurized ink, an ink staging chamber having a nozzle bore to establish a continuous flow of ink in a stream, ink delivery means intermediate said reservoir and said staging chamber for communicating ink between said reservoir and said staging chamber, said channel means comprising a primary ink delivery channel and an adjacent secondary ink delivery channel; and a thermally actuated valve positioned, when closed, to block ink flow through said secondary channel and, when opened, to permit ink flow through said secondary channel, whereby opening and closing of said valve results in deflection of said ink stream between a print direction and a non-print direction.

In accordance with another aspect of the invention, there is provided a method of fabricating a continuous inkjet printhead having a series of inkjet devices each of which includes primary and secondary ink delivery channels, an ink staging chamber having a chamber wall with a nozzle bore aligned with said primary ink delivery channel and a thermally actuated valve positioned over said secondary delivery channel to control, by opening and closing of said valve, deflection of an ink stream emitted from said nozzle bore between print and non-print directions. The fabrication method comprises providing a silicon substrate having a front side and a back side; forming a series of first and second adjacent wells in the substrate corresponding to said primary and secondary ink delivery channels; and depositing a patterned thermally actuated valve device over each of said second wells. The method also includes depositing and patterning sacrificial material over said wells to form a volume corresponding to said ink staging chamber; depositing a chamber wall material over said sacrificial material to define an ink staging chamber wall; etching a nozzle bore in the chamber wall aligned with said first well; and removing said sacrificial material through said nozzle bore thereby forming said ink staging chamber with said valve device released within the chamber. The method further includes etching a channel through the back side of said substrate to said wells to form said primary and secondary ink delivery channels to said ink staging chamber.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
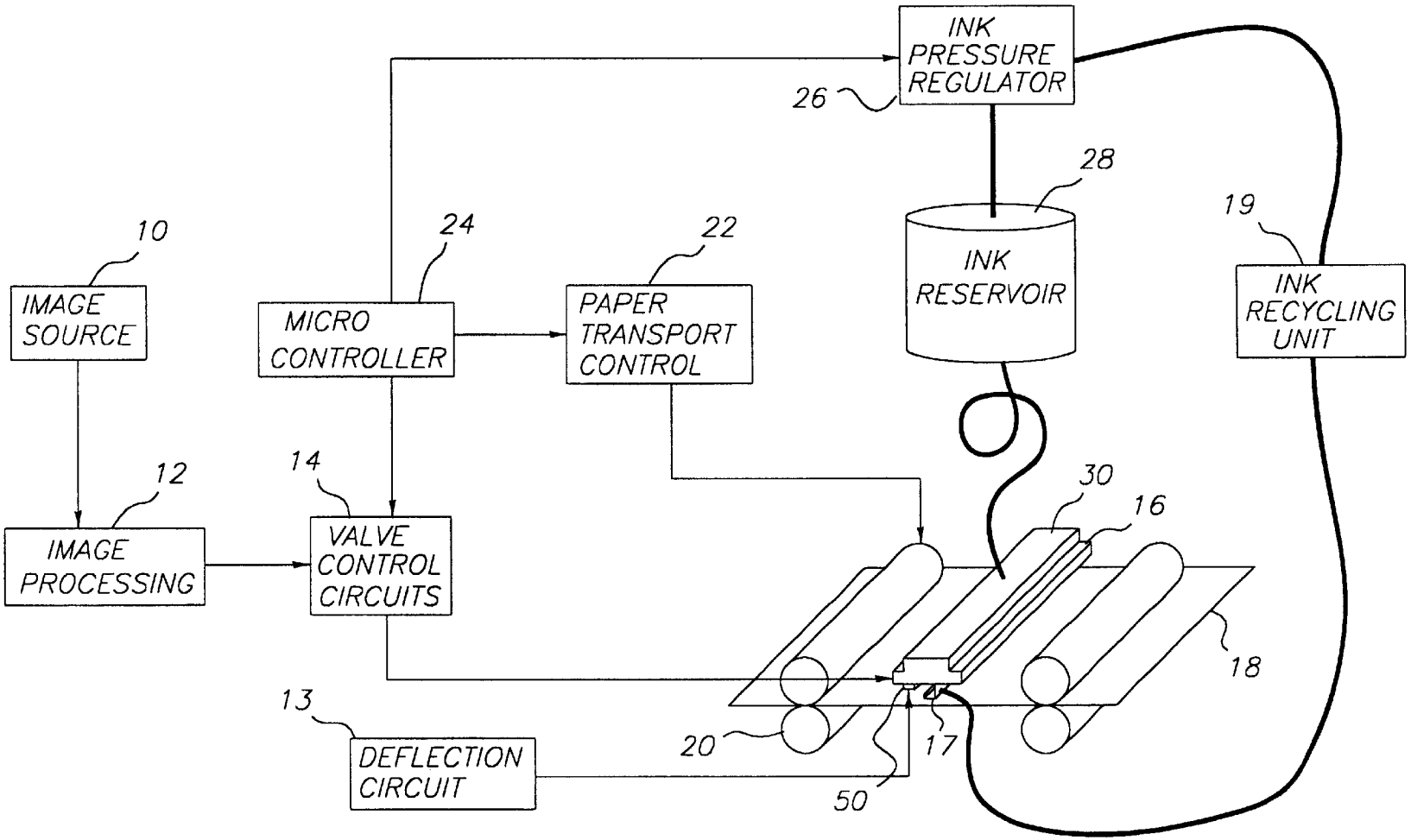
FIG. 1 shows a simplified block schematic diagram of one exemplary printing apparatus according to the present invention.

Referring to FIG. 1, a continuous ink jet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of valve control circuits 14 read data from the image memory and apply time-varying electrical pulses to a set of electrically controlled micro-valves that are part of a printhead 16. These pulses are applied at an appropriate time, and to the appropriate nozzle in the printhead, so that drops formed from a continuous ink jet stream will form spots on a recording medium 18 in the appropriate position designated by the data in the image memory.

Recording medium 18 is moved relative to printhead 16 by a recording medium transport system 20, and which is electronically controlled by a recording medium transport control system 22, which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along the orthogonal axis (the main scanning direction) in a relative raster motion.

Micro-controller 24 may also control an ink pressure regulator 26 and valve control circuits 14. Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface, where a plurality of nozzles and heaters are situated. With printhead 16 fabricated from a silicon substrate, it is possible to integrate valve control circuits 14 with the printhead.

Figure 2:
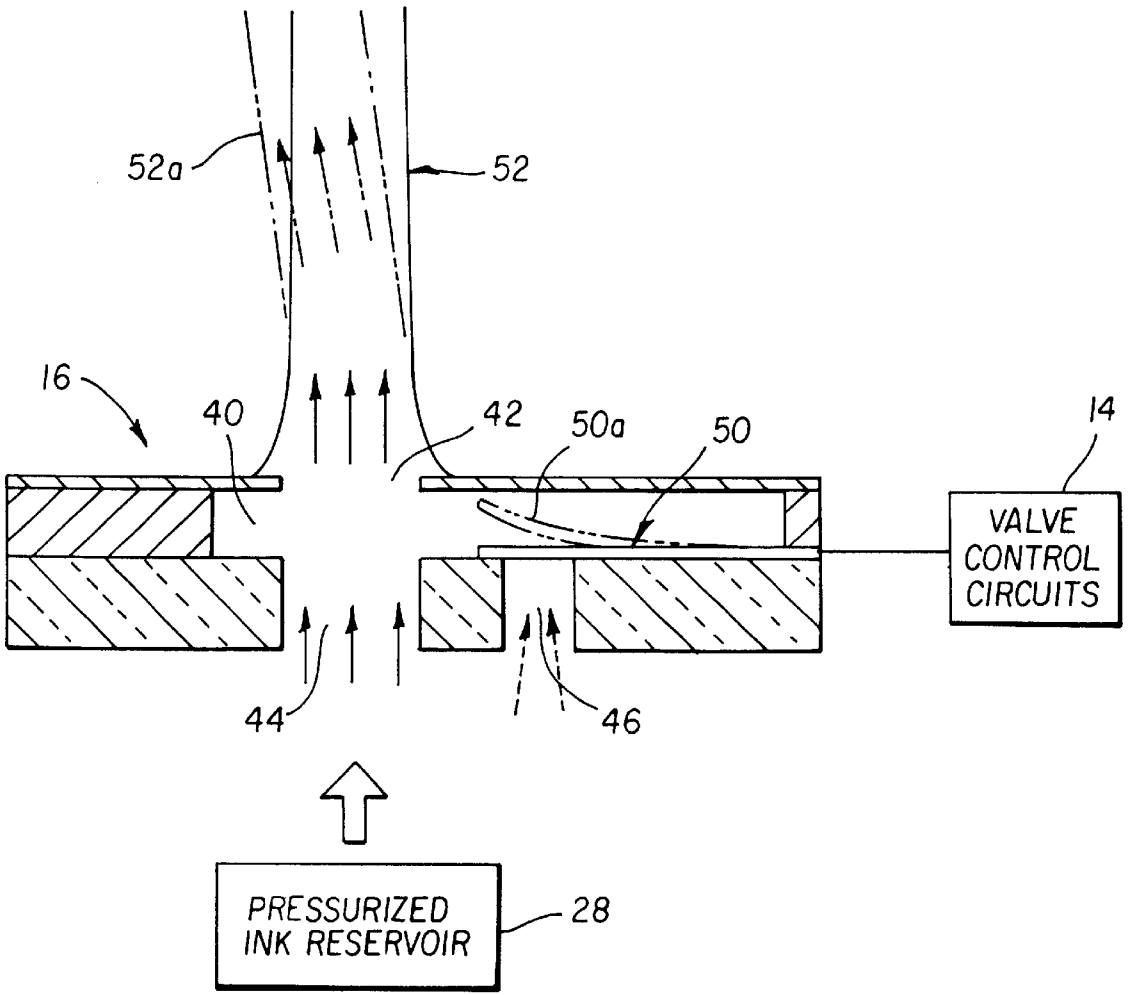
FIG. 2 shows in schematic form a cross-section of a segment of a continuous ink jet printhead illustrating principles of the present invention.

Turning to FIG. 2, a segment of printhead 16 is shown schematically in cross-section. In the illustration the printhead includes an ink staging chamber 40 having a nozzle bore 42 from which ink under pressure is emitted in a stream directed toward the recording medium 18. The pressurized ink from reservoir 28 is communicated via the channel device 30 to the staging chamber 40 by ink delivery channel means 30 which, for each ink jet nozzle comprises a primary ink delivery channel 44 and an adjacent secondary ink delivery channel 46. In the embodiment illustrated, a thermally actuated valve 50, shown in solid line, is positioned within the staging chamber 40 over the secondary channel 46 thereby blocking the flow of ink through the secondary channel 46. With the flow of ink through channel 46 blocked, the pressurized ink flowing through the primary channel 44 is emitted through nozzle bore 42 without deflection as stream 52 shown in solid line. The nozzle bore 42 is preferably axially aligned with the primary ink delivery channel 44 and the secondary ink delivery channel is axially offset from the primary channel in a direction opposite to the desired deflection direction of ink stream as represented by dotted outline 52*a*. When valve 50 is thermally actuated by signals from valve control circuits 14 to raise up as shown by dotted lines 50*a*, pressurized ink flows through secondary channel 46 creating a lateral flow through the staging chamber 40 that combines with the ink flowing axially through the primary channel 44 to the nozzle bore 42. The result of this lateral flow it to cause the deflection of the stream 52 as shown in dotted line 52*a*. Thus, opening and closing of the valve results in deflection of the ink stream between a print direction and a non-print direction depending on the position of the gutter 17.

Figure 3:
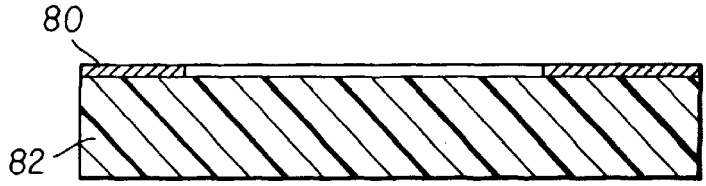
FIGS. 3–17 show in schematic form the steps employed in a method of producing a continuous ink jet printhead in accordance with a feature of the invention.
Figure 4:
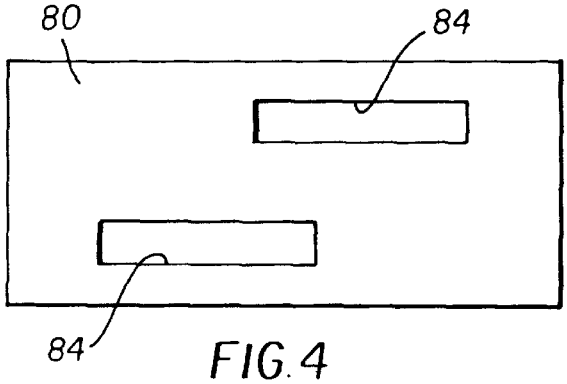
Figure 5:
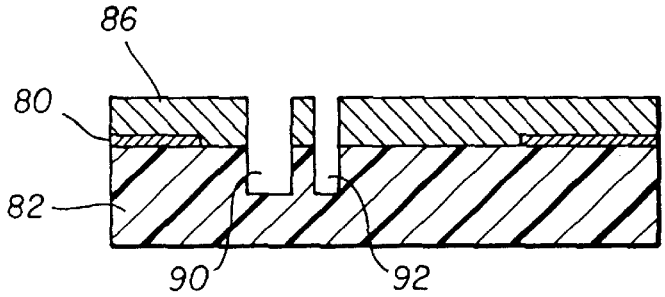
Figure 6:
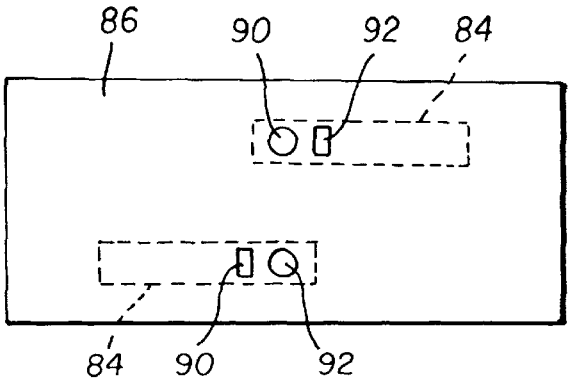

A method by which the printhead of FIG. 2 may be fabricated in accordance with a feature of the invention will now be described with reference to FIGS. 3 through 16. To begin the process, as shown in FIG. 3, an oxide layer 80, preferably in the thickness range of from 0.1 to 1.0 micron, is formed on a silicon substrate 82. This oxide layer is patterned and etched to form an array of rectangular shaped openings 84 as seen in the plan view of FIG. 4. The openings may be staggered as shown in order to allow for access to electrical contact terminals from opposite sides of the substrate. It will be appreciated that these figures are schematic in nature to illustrate the steps of the fabrication process and are not drawn to scale. A resist layer 86 is next applied to the substrate 82 as shown in FIG. 5 by a known spin coating technique and is lithographically patterned. This pattern is etched into the silicon substrate 82 to form substrate wells 90 and 92 in the substrate 82 preferably in the depth range of from 1 to 100 microns as shown in FIG. 6. These wells will ultimately become the primary and secondary ink delivery channels 44 and 46, respectively. In the preferred embodiment illustrated in FIG. 6, well 90 is formed as a cylindrical hole while well 92 is formed as a rectangular slot, although it will be appreciated that other configurations may be employed.

Figure 7:
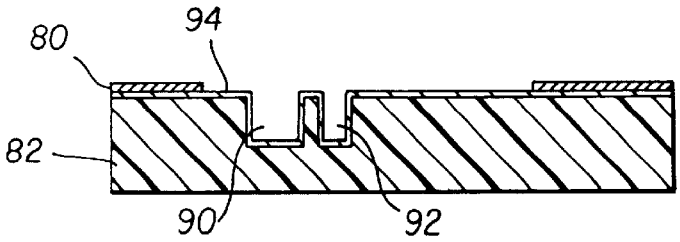
Figure 8:
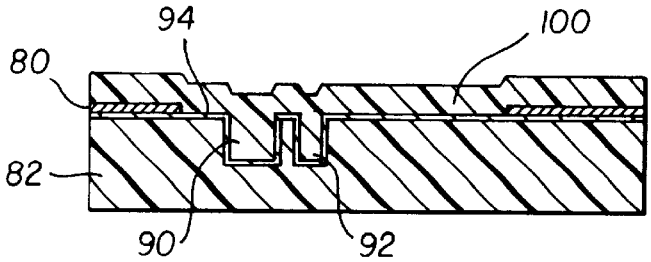
Figure 9:
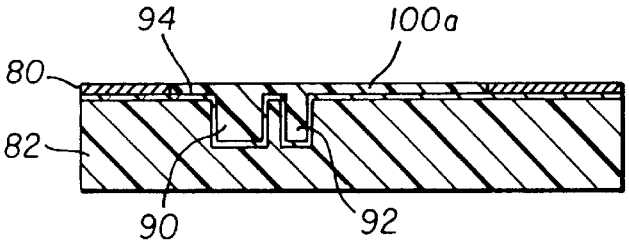

In FIG. 7, the resist layer 86 is stripped and a conformal second oxide layer 94 is grown on the substrate 82. Since the $2^{nd}$ oxide layer is thermally grown the growth takes place at the substrate 82, $1^{st}$ oxide layer 80 interface. So realistically this is where the $2^{nd}$ oxide layer is formed, under the $1^{st}$ oxide layer with thickness in the range of from 0.1 to 1 micron. In FIG. 8, a first sacrificial layer 100 is deposited. The deposited thickness is enough to completely fill substrate wells 90 and 92 as well as the rectangular-shaped openings of modified oxide layer 80. In the preferred embodiment this layer is polysilicon. Alternatively, polyimide may be used. The first sacrificial layer 100 is then made planar to oxide layer 80 in FIG. 9 by chemical mechanical polishing. The chemical mechanical polishing process is designed to etch the first sacrificial layer 100 and stop on the modified oxide layer 80 creating a planarized first sacrificial layer 100*a*.

Figure 10:
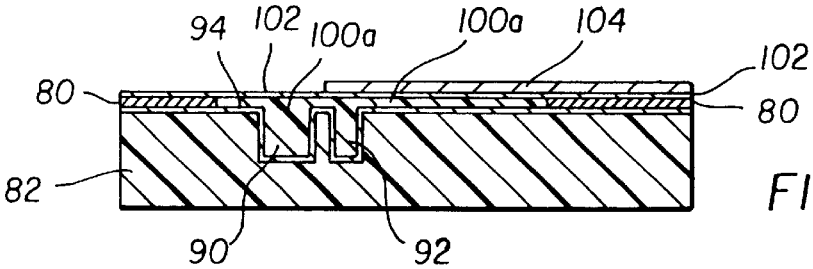
Figure 11:
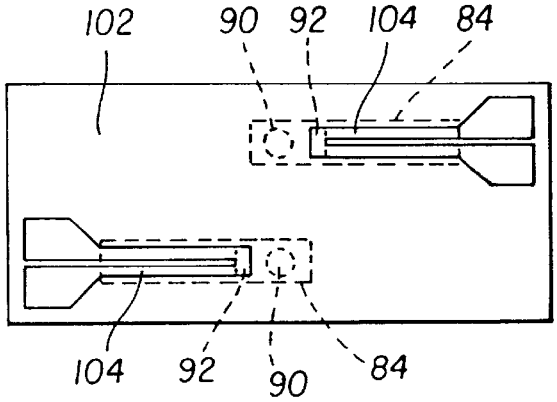
Figure 12:
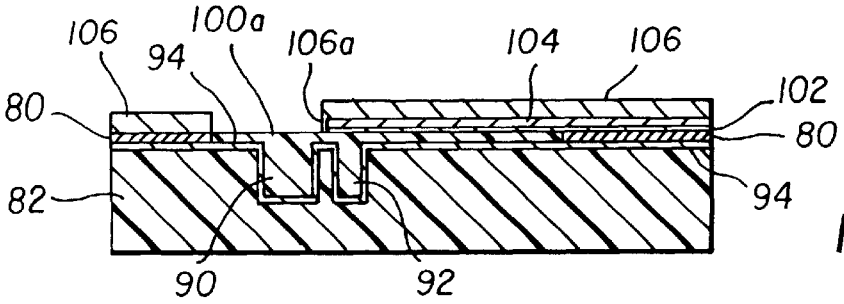

In FIG. 10, a third oxide layer 102 is then deposited preferably in the thickness range of from 0.1 to 1 micron. This is followed by deposition and patterning of a lower valve actuator layer 104 as shown in FIGS. 10 and 11. The criteria for the lower thermal actuator layer 104 are i) high coefficient of thermal expansion; ii) resistivity between 3–1000 $\mu\Omega$-cm; iii) high modulus of elasticity; iv) low mass density; and v) low specific heat. Metals such as aluminum, copper, nickel, titanium, and tantalum, as well as alloys of these metals meet these requirements. In the preferred embodiment, the metal is an aluminum alloy. In FIG. 12, an upper actuator layer 106 is then deposited and then removed in the areas above the planarized first sacrificial layer 100*a* except for the material deposited on the lower actuator layer 104 and a small protective region 106*a* adjacent the lower actuator layer 104. The third oxide layer 102 not protected by the upper actuator layer 106 is also removed during this step. The criteria for the upper actuator layer 106 are i) low coefficient of thermal expansion; and ii) the layer should be electrically insulating. Dielectric materials such as oxides and silicon nitride meet these requirements. In the preferred embodiment, the dielectric material is an oxide. The protective region 106*a*, along with the third oxide layer 102, completely encloses the lower actuator layer 90, protecting it from the ink.

Figure 13A:
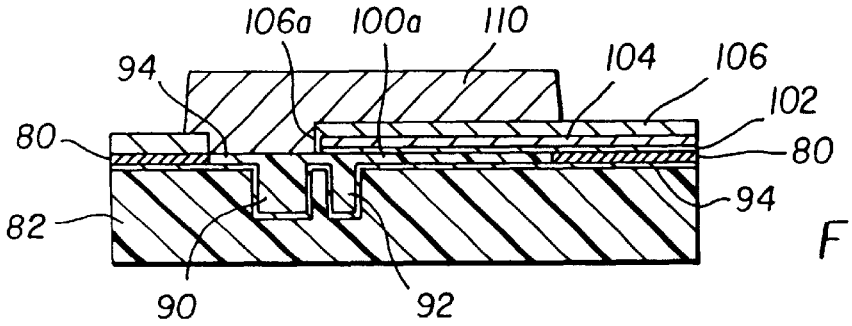
Figure 13B:
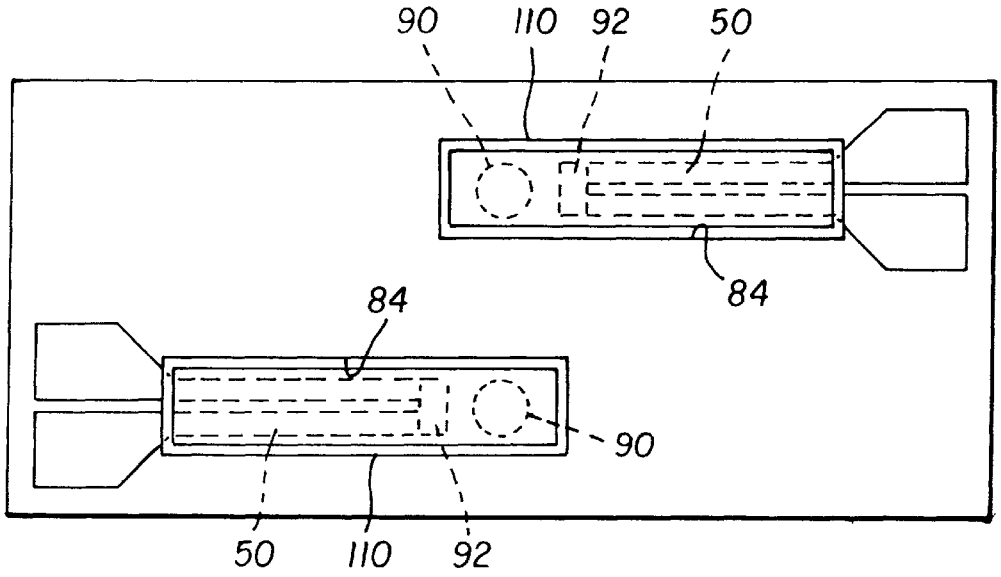

In FIG. 13*a*, a second sacrificial layer 110 is deposited and lithographically patterned. The second sacrificial layer encloses the rectangular shaped opening 84 (FIG. 13*b*) including the thermally actuated valve 50 and substrate well 90, 92. In the preferred embodiment, this material is photoimageable polyimide. This material can be spun on and patterned by masked exposure and development. The material is then final cured at 350 C. to provide a layer preferably in the thickness range 2–10 microns. A slight etchback in an oxygen plasma can be performed to adjust the final thickness and descum the surface. After subsequent removal, the volume occupied by this second sacrificial layer will become the in ink staging chamber 40 (FIG. 2).

Figure 14:
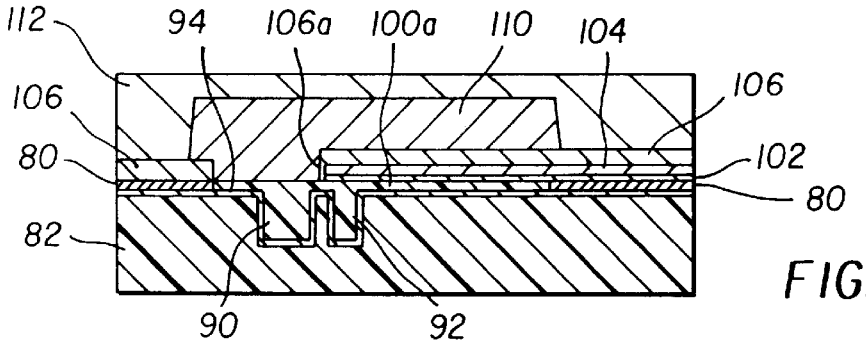

In FIG. 14, a thick chamber wall layer 112 is then deposited with a preferred thickness so that all regions between the second sacrificial layer 110 will be filled up and result in a thickness on top of the second sacrificial layer 110 that is greater than 1 micron. In the preferred embodiment this material is an oxide layer. Other materials such as silicon nitride or oxynitrides can be used as well as combinations of this material to form the chamber wall layer 112. This layer can then be planarized by chemical mechanical polishing with a preferred final thickness of the chamber wall layer 112 above the second sacrificial layer 110 to be greater than 1 micron.

Figure 15:
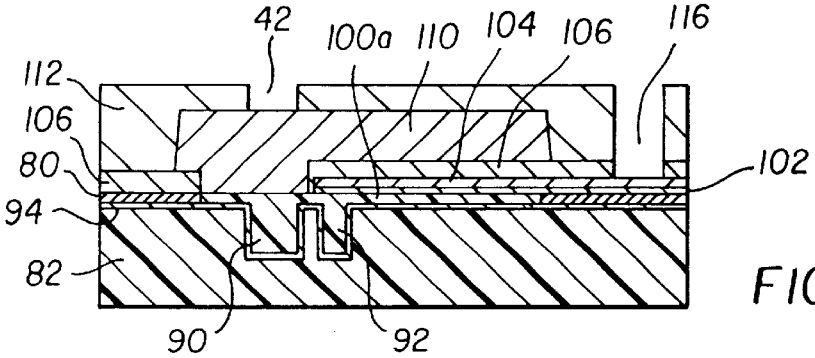
Figure 16:
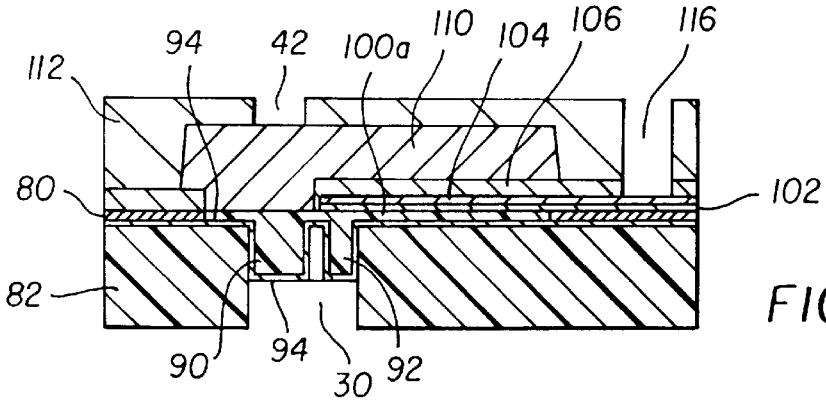
Figure 17:
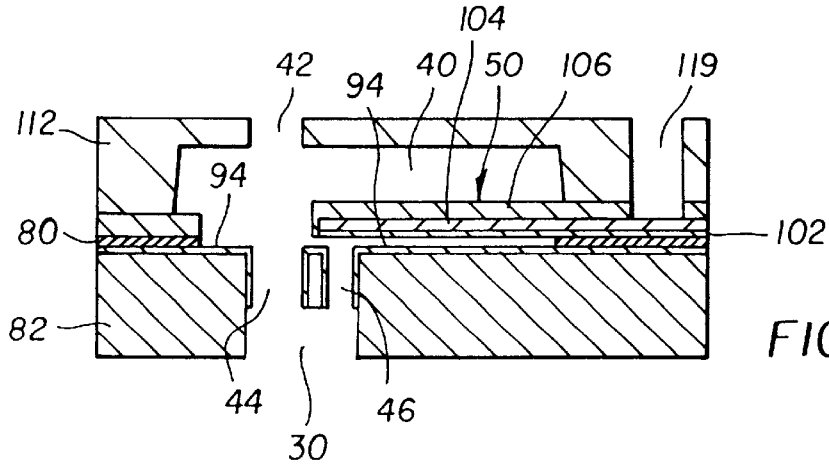

In FIG. 15, the chamber wall layer 112 is next patterned and etched to form the nozzle bore 42 for the ejection of ink. The etch process also opens up a through-hole 116 in the chamber wall as well as in the upper actuator layer 106 so that electrical contact can be made to the lower actuator layer 104 which in turn activates the thermally actuated valve 50. In FIG. 16, the back side of the silicon substrate 82, is then patterned and ink feed channels 30 are etched into the silicon substrate 10 until they meet the liner oxide 94 coating the bottoms of the wells 90 and 92. The first sacrificial layer 100*a*, and second sacrificial layer 110 are then removed through the nozzle bore 42 with plasma etchants which do not attack the chamber wall layer 112. This step will create the ink staging chamber 40, clear away the sacrificial layer from wells 90 and 92, and release the thermal actuator 50 (FIG.2) comprised of lower actuator layer 104 and upper actuator layer 106. For polyimide sacrificial layers an oxygen plasma is used. For polysilicon sacrificial layers $XeF_2$ (Xenon Difluoride) or $SF_6$ (Sulfur Hexafluoride) is used. Finally the liner oxide 94 coating the bottoms of the wells 90 and 92 is removed by etching from the back of the silicon substrate 10 thereby creating the primary and secondary ink delivery channels 44 and 46 (FIG. 17). Once the thermal valve actuator is released upon removal of the sacrificial layers, the bottom layer 104 of the actuator will be in a state of tensile stress that will cause the actuator to bend towards the opening of the secondary ink delivery channel thereby minimizing any leakage while the actuator is in the off (closed) state. More importantly, some minimal leakage can be tolerated in the off state. Such minimal leakage will cause a slight deflection of the ink stream 52 resulting in an initial deflection bias. However, this will not significantly affect the operation since what is most important is the change in deflection of the ink stream between the closed and open state of the thermal actuator.

The invention has been described in detail with particular reference to certain preferred embodiments thereof, but it will be understood that variations and modifications can be effected within the spirit and scope of the invention.

| PARTS LIST | |
|---|---|
| 10 | image source |
| 12 | image processing unit |
| 14 | valve control circuits |
| 16 | printhead |
| 17 | ink gutter |
| 18 | recording medium |
| 20 | recording medium transport system |
| 22 | transport control system |
| 24 | micro-controller |
| 26 | ink pressure regulator |
| 28 | ink reservoir |
| 30 | ink channel device |
| 40 | ink staging chamber |
| 42 | nozzle bore |

-continued

| PARTS LIST | |
|---|---|
| 44 | primary ink delivery channel |
| 46 | secondary ink delivery channel |
| 50 | thermally actuated valve |
| 52 | ink stream |
| 80 | first oxide layer |
| 82 | silicon substrate |
| 84 | openings |
| 86 | resist layer |
| 90, 92 | substrate wells |
| 94 | conformal oxide layer |
| 100 | first sacrificial layer |
| 104 | lower thermal actuator layer |
| 106 | upper actuator layer |
| 110 | second sacrificial layer |
| 112 | chamber wall layer |
| 116 | through hole |

What is claimed is:

1. An apparatus for controlling fluid flow in a continuous flow control device in which a continuous stream of fluid is emitted from a nozzle bore; said apparatus comprising:

a reservoir of pressurized fluid;

a fluid staging chamber having a nozzle bore to establish a continuous flow of fluid in a stream;

a fluid delivery means intermediate said reservoir and said staging chamber for communicating fluid between said reservoir and said staging chamber, said fluid delivery means comprising a primary fluid delivery channel passing a primary flow of fluid through said staging chamber to the nozzle bore to create emission of an undeflected fluid stream from the nozzle bore and an adjacent secondary fluid delivery channel into the fluid staging chamber; and a valve positioned, when closed, to block fluid flow through said secondary fluid delivery channel and, when opened, to permit fluid flow through said secondary channel into the staging chamber so as to impinge said primary flow of fluid to deflect the fluid stream.

2. The apparatus of claim 1 wherein said nozzle bore is aligned with said primary fluid delivery channel and said secondary fluid delivery channel is offset from said primary fluid delivery channel in a direction opposite to the deflection direction of said fluid stream.

3. A method of controlling deflection of a fluid stream emitted from a continuous flow head comprising:

passing a primary flow of fluid from a pressurized fluid reservoir via a primary fluid delivery channel through a fluid staging chamber to a nozzle bore to create emission of an undeflected fluid stream from the head; and controllable passing a secondary flow of fluid from said pressurized fluid reservoir via a secondary fluid delivery channel through said fluid staging chamber to said nozzle bore to create a lateral flow of fluid which impinges said primary flow of fluid in the staging chamber to thereby cause said emitted fluid stream to be deflceted in a direction away from said impinging lateral flow of fluid.

4. An apparatus for controlling fluid in a continuous fluid flow control device in which a continuous stream of fluid is emitted from a nozzle bore; said apparatus comprising:

a reservoir of pressurized fluid;

a fluid staging chamber having a nozzle bore to establish a continuous flow of fluid in a stream;

a fluid delivery means intermediate said reservoir and said staging chamber for communicating fluid between said reservoir and said staging chamber, said fluid delivery means comprising a primary fluid delivery channel for providing a first continuous flow of fluid in a stream from the nozzle bore in a first direction and an adjacent secondary fluid delivery channel for providing a second flow of fluid that combines with the first continuous flow of fluid in the staging chamber to deflect the stream of fluid in a second direction; and a valve positioned, when closed, to block fluid flow through said secondary fluid delivery channel and, when opened, to permit fluid flow through said secondary channel.

5. An apparatus for controlling the direction of a stream of a first fluid, the apparatus comprising:

a supply of pressurized ink;

a supply of a pressurized second fluid;

a fluid staging chamber having a fluid delivery wall and an opposing fluid exit wall, said fluid exit wall having a nozzle bore and said fluid delivery wall having a primary fluid delivery channel aligned with the nozzle bore and providing a flow of fluid through the staging chamber creating an emission of an undeflected stream from the nozzle bore, said fluid delivery wall further comprising a secondary fluid delivery channel adjacent to the primary fluid delivery channel for providing a flow of the second fluid that combines with the flow of fluid in the staging chamber to deflect the stream; and a valve positioned to block fluid flow through said secondary fluid delivery channel when closed and to permit fluid flow through said secondary channel when open causing deflection of said stream from the nozzle bore.

6. The apparatus of claim 5, wherein the fluid delivery wall and the fluid exit wall are separated by 2–10 microns.

7. The apparatus of claim 5 wherein the fluid delivery wall has a thickness of greater than one micron.

8. The apparatus of claim 5 wherein said supply of pressurized fluid comprises a supply of pressurized ink.

9. The apparatus of claim 5 wherein said valve is fixed to the fluid delivery wall.

10. The apparatus of claim 5 wherein said valve is formed from the same substrate as the fluid delivery wall.

11. The apparatus of claim 5 wherein said valve comprises a lower actuator layer, and an upper actuator layer both fixed to the fluid delivery wall.

12. The apparatus of claim 11 wherein said lower layer comprises an electrical conductor and said upper actuator layer comprises a dielectric material with said valve opening when an electrical charge is applied to the electrical conductor.

* * * * *

UNITED STATES PATENT AND TRADEMARK OFFICE

CERTIFICATE OF CORRECTION

PATENT NO. : 6,695,440 B2
DATED : February 24, 2004
INVENTOR(S) : Christopher N. Delametter et al.

It is certified that error appears in the above-identified patent and that said Letters Patent is hereby corrected as shown below:

Title page, Item [54] and Column 1, line 1,
Title, delete "MAKING", and insert -- CONTROLLING --

Signed and Sealed this

Seventeenth Day of August, 2004

JON W. DUDAS
*Acting Director of the United States Patent and Trademark Office*